United States Patent [19]

Grove

[11] 4,300,920

[45] Nov. 17, 1981

[54] STACK GAS REHEATER SYSTEM

[75] Inventor: Edward E. Grove, Tulsa, Okla.

[73] Assignee: Tranter, Inc., Tulsa, Okla.

[21] Appl. No.: 53,318

[22] Filed: Jun. 29, 1979

[51] Int. Cl.[3] ..... B01D 47/00

[52] U.S. Cl. ..... 55/84; 55/257 HE; 55/312; 55/261; 261/152; 261/DIG. 77; 165/134 DP

[58] Field of Search ..... 55/511, 80, 257 HE, 55/84, 312, 135, 226, 268, 269, 261; 165/134 DP; 261/152, DIG. 77; 137/240, 22 C

[56] References Cited

U.S. PATENT DOCUMENTS

| | | | |
|---|---|---|---|
| 3,818,682 | 6/1974 | Farrow | 55/5 |
| 3,880,622 | 4/1975 | Howell | 261/152 |
| 4,152,123 | 5/1979 | Hegemann et al. | 55/DIG. 77 |

FOREIGN PATENT DOCUMENTS

| | | | |
|---|---|---|---|
| 2554096 | 6/1977 | Fed. Rep. of Germany | 55/89 |
| 52-13473 | 2/1977 | Japan | 55/94 |
| 578130 | 10/1977 | U.S.S.R. | 134/22 C |

*Primary Examiner*—Bernard Nozick
*Attorney, Agent, or Firm*—William S. Dorman

[57] ABSTRACT

In a method of treating flue gas which results from the burning of coal in a boiler wherein the flue gas is passed through a wet scrubber and proceeds in a saturated condition as a flue gas stream to an exhaust fan and then up a stack to the atmosphere, and wherein a reheat heat exchanger is employed to heat the saturated flue gas prior to its introduction to the exhaust fan to a sufficiently high temperature above its dew point the improvement in that method which comprises heating at least a portion of the flue gas stream subsequent to its passage through the wet scrubber and prior to its passage through the reheat heat exchanger to prevent any condensation from the flue gas stream in or on the reheat heat exchanger.

1 Claim, 3 Drawing Figures

STACK GAS REHEATER SYSTEM

Background of the Invention

1. Field of the Invention

The present invention relates to a stack gas reheater system of the type where saturated flue gas is reheated in a reheat heat exchanger to prevent condensation in the stack and in the exhaust fan which conveys the flue gas to the stack. More particularly, the present invention relates to a reheater system whereby further additional heat is added to the flue gas stream upstream of the reheat heat exchanger to prevent condensation in the reheat heat exchanger whose primary function is indicated above.

2. Description of the Prior Art

There are many boilers throughout the country, and throughout the world, where coal and similar materials are burned and wherein water is introduced to the boiler and steam is withdrawn as a source of energy. The combustion, or flue, gas which leaves the boiler is treated to recover possible valuable by-products from the gas stream and/or to remove various solid, liquid or gaseous materials which might otherwise contaminate the atmosphere. Thus, it is somewhat conventional to treat the combustion gas, after it leaves the boiler, by passing the same through a collector where suspended particles are removed from the gas, preferably by electrostatic means. It is also more or less conventional to pass the combustion gas, or flue gas, after it leaves the collector, through a scrubber where the gas is contacted with a stream of water (preferably hot) or other liquid to remove $SO_2$ and other soluble gases. However, the gas which leaves the scrubber, somewhat cooler than when it entered the scrubber, is not only saturated with water vapor, but it generally contains fine droplets of liquid. In the absence of some means of adding heat to the flue gas stream after leaving the scrubber, the flue gas would normally deposit condensed liquid on the exposed parts of the exhaust fan and in the stack leading up to the atmosphere, which condensed liquid would cause corrosion on the exposed fan parts and in the stack.

It has been proposed in the past to add a reheat heat exchanger to the flue gas stream between the scrubber and the exhaust fan so that the flue gas stream can be heated to a sufficiently high temperature above its dew point that condensation in the exhaust fan and in the stack is prevented. On the other hand, it has been observed that condensation, nevertheless, takes place on the coils of the reheat heat exchanger itself which means that the reheat heat exchanger must be made of very expensive anti-corrosive materials, or the reheat heat exchanger must be replaced after a period of time due to corrosion.

Therefore, it is a primary purpose of the present invention to add heat to the flue gas stream downstream of the scrubber but prior to its introduction into the reheat heat exchanger to prevent condensation of the flue gas stream in the reheat heat exchanger.

SUMMARY OF THE INVENTION

Coal or other combustible fuel is burned in a boiler (which is not described herein and which forms no part of the invention) where water is introduced and steam is withdrawn as a source of power or energy. The combustion gas, flue gas, is led away from the boiler where it is first introduced to a collector (which is not described herein and which forms no part of this invention) where solid particles are removed, preferably by electrostatic means. After passing from the collector, the flue gas stream is introduced into a scrubber (which is shown diagrammatically and briefly described herein but which forms no part of this invention) where the flue gas stream is contacted with a stream of water or other liquid to remove $SO_2$ and other soluble gases. However, the gas which comes out of the scrubber is not only saturated with water vapor but it generally contains fine droplets of liquid. It is further conventional to provide a reheat heat exchanger to heat the flue gas sufficiently above its dew point so that there will be no liquid condensation when the flue gas passes up the stack (briefly described herein) and through the fan (also briefly described herein) which conveys the flue gas stream to the stack.

In accordance with one form of the present invention, the reheat heat exchanger is located in the main stream or conduit which leads from the scrubber to the fan and a side stream of heated air is introduced into the main stream at a location between the scrubber and the reheat heat exchanger to raise the temperature of the flue gas stream above the dew point thereof so as to prevent condensation on the coils or other parts of the reheat heat exchanger.

A modification of the present invention involves a system wherein a side stream of flue gas is withdrawn from the main stream, a reheat heat exchanger is located in the side stream and a separate fan is located upstream of this reheat heat exchanger. A by-pass stream is provided to conduct a portion of the side stream in a reverse direction from a location downstream of the reheat heat exchanger to a position upstream of the fan; this modification involves the provision of a second reheat heat exchanger at a location immediately upstream of the fan but downstream of the location where the by-pass reconnects with the side stream. This second heat exchanger is to prevent condensation, particularly at start-up, on the fan and reheat heat exchanger. Thus, the second heat exchanger (described in the specification and indicated in the drawings as the "Primary Reheat Exchanger") can be eliminated, in effect, after start-up. That is, once the temperature of the combined gases exceeds the dew point of the flue gas, the supply of steam to the upstream heat exchanger can be eliminated, thus eliminating the function of this heat exchanger.

In accordance with a third form of the present invention, a side stream of flue gas is withdrawn from the main flue gas stream and the reheat heat exchanger is located in this side stream which is led back to the main stream at a point prior to its introduction to the exhaust, or induced draft, fan. A separate fan is also located in the side stream between the point of its withdrawal and the reheat heat exchanger. A by-pass stream is taken from the side stream at a point downstream from the reheat heat exchanger and reintroduced to the side stream at a point upstream from the fan. The by-pass stream serves to add heat to the side stream prior to its introduction to the fan and reheat heat exchanger, hence eliminating condensation. Purging of the side stream is accomplished at time of shut-down.

The second and third embodiments of the invention are provided with suitable dampers to effect the results described above.

DETAILED DESCRIPTION OF THE PREFERRED EMBODIMENTS

Figure 1:
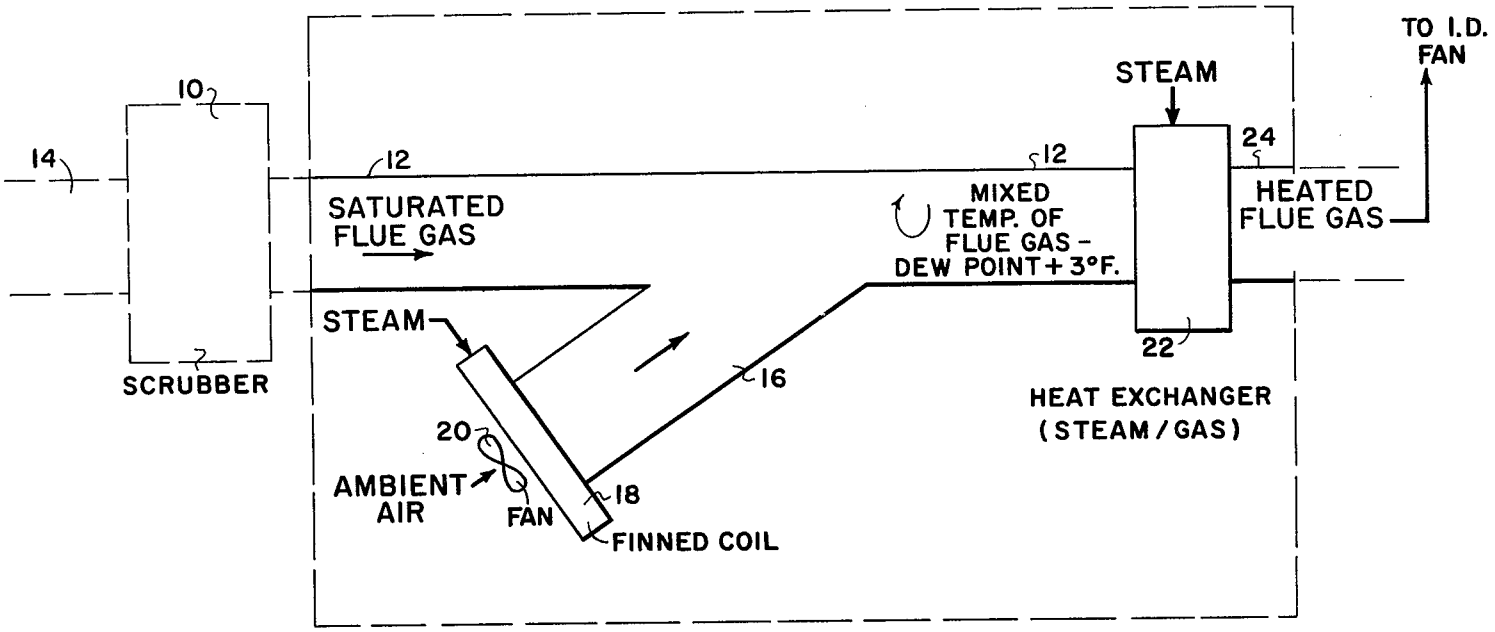
FIG. 1 is a diagrammatic illustration of one form of the present invention.

Referring to the drawings in detail, FIG. 1 shows a schematic representation of a system for heating flue gas which issues, in a saturated condition, from a wet scrubber 10 through a conduit 12. This flue gas is generally, but not necessarily, the combustion gas which results from the burning of coal in a boiler (not shown) where water is introduced and steam is withdrawn. The combustion gas leaves the boiler through a conduit (not shown) and passes first through a collector (not shown) where particles of solids suspended in the gas are removed, preferably by electrostatic means (not shown). The combustion gas, or flue gas, passes from the collector through a conduit 14 and into the scrubber 10 where the gas is contacted with a stream of (hot) water (not shown) or other liquid to remove $SO_2$ and other soluble gases. However, the gas which comes out of the scrubber through the conduit 12 is not only saturated with water vapor but it generally contains fine droplets of liquid. Therefore, it is the purpose of the present invention to heat the flue gas stream to a temperature sufficiently above its dew point so that there will be no condensation in the stack (not shown) or in the induced draft fan or exhaust fan (not shown). It is a further object of the present invention to provide heat to the saturated flue gas in the conduit 12 so that there will be no initial condensation in the heat exchanger which is used to heat the gas to prevent its condensation in the stack in fan referred to above.

Accordingly, the system of FIG. 1 further provides an angled conduit 16 which introduces approximately 25% by volume of ambient air (as compared to the volume of the saturated flue gas) into the conduit 12. A heater or finned coil 18 is mounted on the inlet to the conduit 16 and steam is introduced into the coils of the heater 18 while air is blown over the finned coils and through the heater into the angled conduit 16 by means of a fan 20. The result of the addition of hot air from the angled conduit 16 is such that the temperature of the combined stream at the right-hand end of the conduit 12 is now raised to approximately 153° F., which is about 3° above the dew point of the gas stream. At this juncture it might be worthwhile to note that the saturated flue gas at the left-hand end of the conduit 12 is at approximately 125° F. At any event, the gas stream can now be introduced into the heat exchanger 22 above the condensation temperature of the gas and, therefore, no wet gas and no liquid droplets come into contact with any of the heat exchange components (not shown) which form the heat exchanger 22. Steam is introduced to the heat exchanger to the heat the gas passing through the heat exchanger from the conduit 12. The heated flue gas passing out of the heat exchanger 22 through the conduit 24 is now heated to a sufficiently high temperature above its condensation temperature that there will be no condensation in the stack (not shown) or in the induced draft fan or exhaust fan (not shown) to which this flue gas is immediately conducted.

Figure 2:
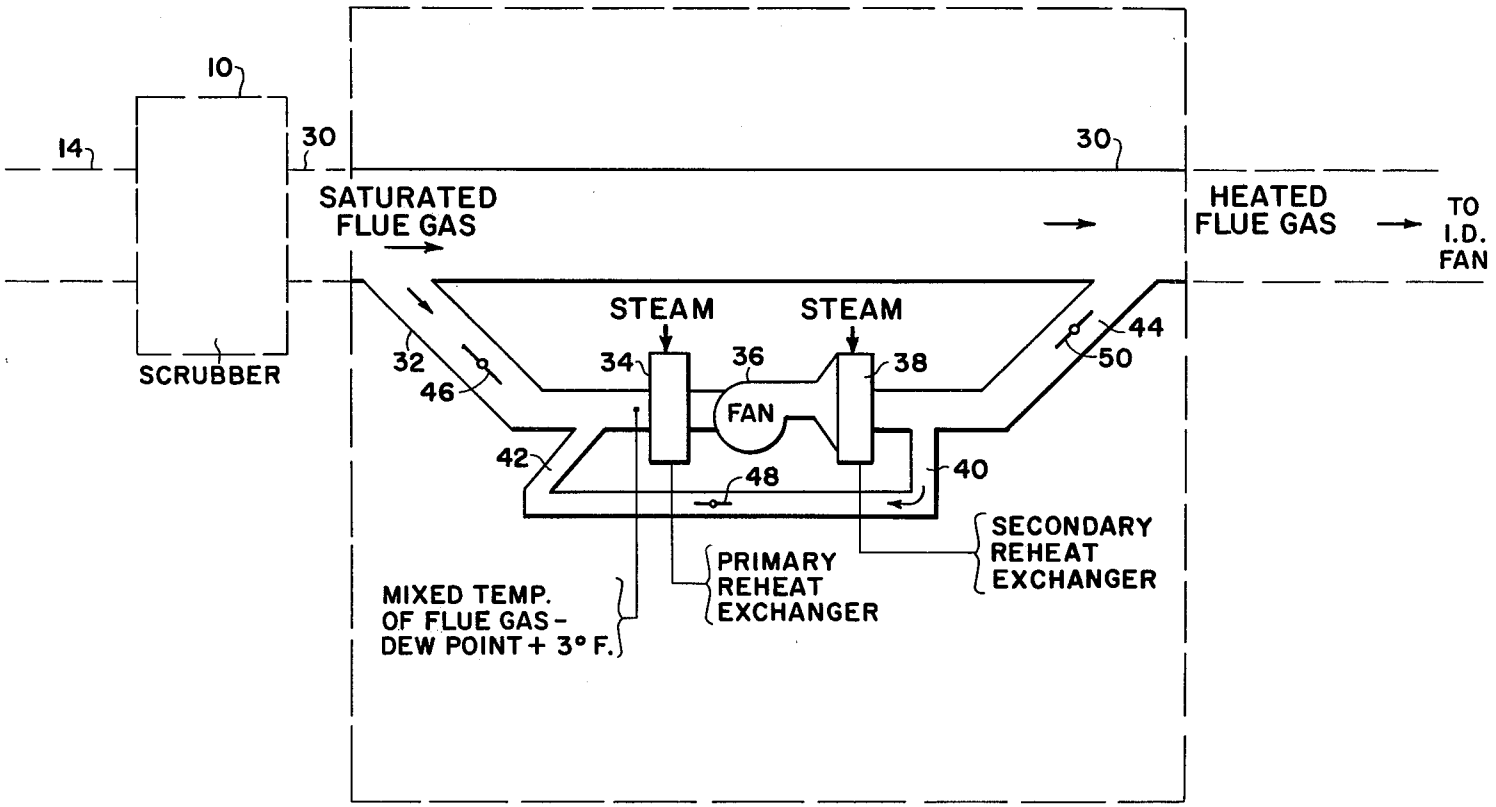
FIG. 2 is a diagrammatic illustration of another form of the present invention.

Referring now to FIG. 2, this figure represents a modification wherein a side stream is taken from the main stream of the saturated flue gas. As in the case of FIG. 1, the flue gas passes from the collector (not shown) through a conduit 14 into the scrubber 10. The saturated flue gas from the scrubber 10 passes out through a conduit 30; however, in the case of FIG. 2, a portion (approximately 25%) of the gas stream from the conduit 30 is taken off to an angled conduit 32 so as to pass, in sequence, through a primary heat (or reheat) exchanger 34, a fan 36 and a second heat exchanger 38. A portion of this side stream issuing from the heat exchanger 38 is taken off through a by-pass conduit 40 and passes backwardly into an angled conduit 42 just in advance of the first heat exchanger 34. As a result of the reversed side stream through the conduits 40 and 42, a portion of the gases coming out of the heat exchanger 38 are returned to the inlet side of the heat exchanger 34 so as to mix with the incoming gases from the conduit 32. After the system of FIG. 2 has been started up, the temperature to the left of the heat exchanger 34 will preferably be at the dew point plus 3° F. or about 153° F. In fact, after the system has been started up, it is possible to discontinue the supply of steam through the heat exchanger 34. In any event, the gas leaving the heat exchanger 38 through the angled conduit 44 and back into the main conduit 30 is at approximately 300° F. so that, to the right of the connecting point between the conduits 30 and 44, the total gas stream will be at approximately 175° F. such that there will be no condensation in the stack (not shown) or in the induced draft fan (not shown) in which this heated flue gas is immediately conducted.

The system of FIG. 2 also includes a wet gas damper 46 in the conduit 32 and another wet gas damper 50 in the conduit 44; a secondary damper 48 can also be provided in the conduit 40 to vary the amount of gas recycled through the by-pass conduit 40, if desired. At the time of start-up, the wet gas dampers 46 and 50 are closed while the fan is operating and steam is applied to the primary and secondary heat exchangers 34 and 38 to effect a heat-up gas recirculation system. The primary reheater 34 protects the fan 36 against corrosion at the time of start-up. The gas recirculation at start-up (with dampers 46 and 50 closed) makes it possible for the heat exchanger 34 to be constructed of carbon steel. Heat exchanger 38 is also constructed of carbon steel. After the temperature of the recirculating gas reaches approximately 153° F., the wet gas dampers 46 and 50 are opened and the portion of the flue stream is introduced into the side stream through the conduit 32 and returned to the main stream through the conduit 44. For greater fan efficiency, steam can be discontinued from the primary heat exchanger 34 during normal and continuous operation.

Figure 3:
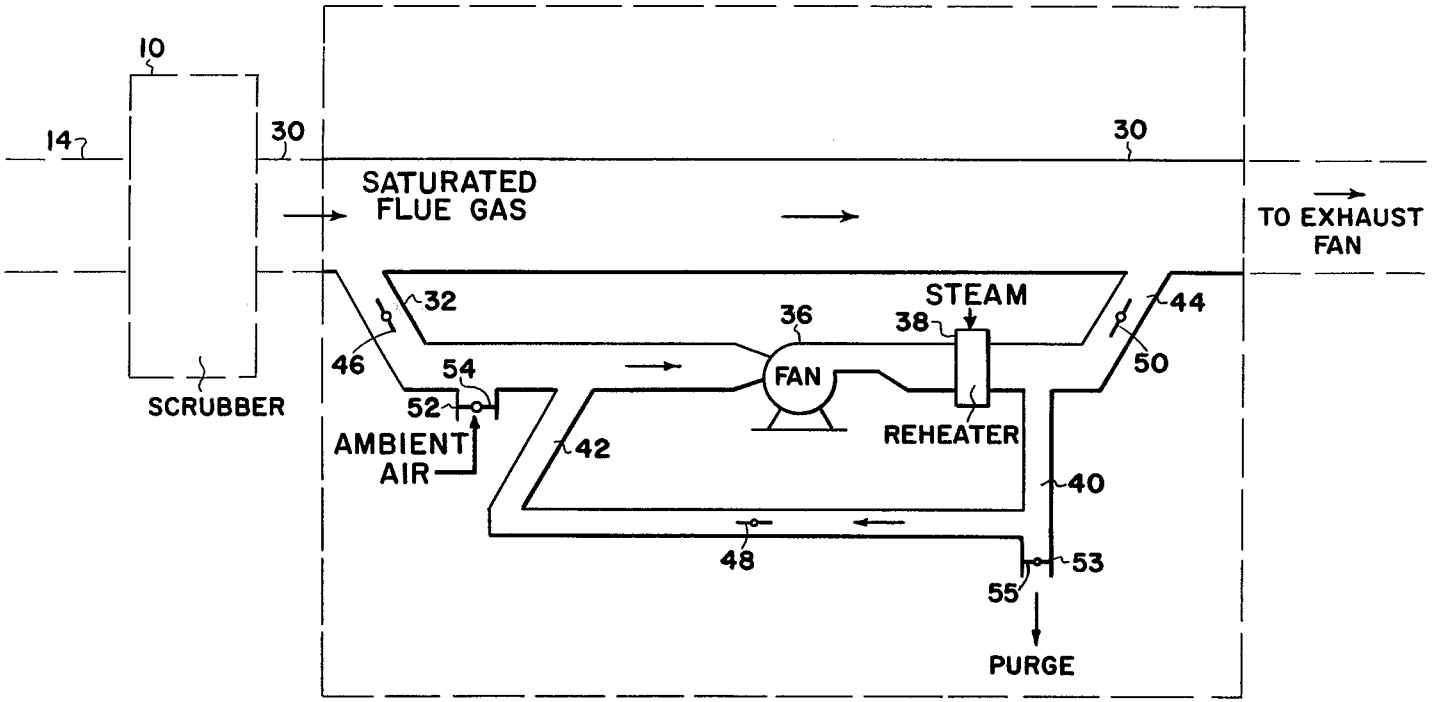
FIG. 3 is a diagrammatic illustration of still another form of the present invention.

Referring now to FIG. 3, this figure shows a modification of FIG. 2 wherein the primary reheat exchanger 34 is eliminated. As in the case of FIG. 2, the flue gas passes from the collector (not shown) through a conduit 14 and into the scrubber 10. The saturated flue gas passes from the scrubber 10 through a conduit 30. Just as in the case of FIG. 2, an angled conduit 32 takes off a portion (approximately 25%) of the gas stream from the conduit 30. From the angled conduit, the gas passes to a fan 36 (note that the primary heat exchanger 34 has been eliminated); from the fan 36, the side stream of the flue gas passes to a heat exchanger 38 which, in the case of FIG. 3, is the only heat exchanger employed in this side stream. A portion of the side stream issuing from the heat exchanger 38 is taken off through a by-pass conduit 40 and passed backwardly into an angled conduit 42 which connects with the conduit 32 upstream of the fan 36. The system of FIG. 3 also includes an angled conduit 44 connecting from the discharge side of the heat exchanger 38 into the main stream 30, wet gas dampers 46 and 50 and a secondary damper 48 in the by-pass conduit 40. The significant difference between FIGS. 2 and 3, apart from the elimination of the primary heat exchanger 34 is the addition, in FIG. 3, of openings 52 and 53 in the side stream, an ambient air damper 54 located in the opening 52 and an exhaust damper 55 located in the opening 53.

With respect to FIG. 3, at the time of shut-down, the wet gas dampers 46 and 50 are closed to prevent wet gases from passing through the fan 36 and the heat exchanger 38; the ambient air damper 54 and the exhaust damper 55 are opened. The fan 36 remains on and a stream of ambient air is allowed to circulate through the fan 36, the heat exchanger 38, and is released to the atmosphere through exhaust damper 55 to purge the system. With the system purged, the problem of condensation at the time of start-up, inherent with FIG. 2, is eliminated.

When the systems shown in FIG. 2 and FIG. 3 have been operating for a period of time, they will be operating in substantially the same manner; that is, the gas leaving the heat exchanger 38 through the angled conduit 44 in FIG. 3 will also be at approximately 300° F. so that the total gas stream to the right of the connecting point between the conduits 30 and 44 will be at a temperature of 175° F. in order, as previously explained, to prevent condensation in the stack or in the induced draft fan.

To further understand the inventions disclosed above, a few operating conditions will be briefly described. It will be assumed that 1,125,000 pounds per hour (pph) are passing out of the wet scrubber 10 in saturated condition at 125° F. into each of the systems of FIGS. 1,2 and 3. It will be further assumed that the gas stream leaving each of the systems shown in these figures and going to the exhaust fan will be at 175° F. Finally, it will be assumed that the temperature of the gas stream being introduced into any of the heat exchangers (after start-up) will be at 153° F. With regard to FIG. 1, only, it will be assumed that the ambient air passing through the angled conduit 16 will be introduced to the main conduit 12 at a temperature of 290° F. Under these circumstances, it will be necessary to add 177,356 pph of air heated to 290° F. through the angled conduit 16; and under these conditions 1,302,356 pph of heated flue gas (mixed with heated air) will issue from the conduit 24 at a temperature of 175° F.

Turning now to a further consideration of FIG. 2, if the side stream passing from the angled conduit into the main conduit 30 is at 300° F., it has been calculated that approximately 251,248 pph should be taken from the side stream through the conduit 32 and passes through the system of FIG. 2; this means, of course, that this same 251,248 pph will be passing from the conduit 44 into the main conduit 30. In order to achieve a temperature of 153° F. (which is 3° F. above the dew point) at the place where the angled conduit 42 connects with the side conduit 32, approximately 30,333 pounds per hour of heated gas must be withdrawn through the by-pass conduit 40. Thus, the gas stream flowing through the primary heat exchanger 34, the fan 36 and the secondary heat exchanger 38 in FIG. 2 will be approximately 281,581 pph. Again, as indicated above, after start-up it would be possible to discontinue the passage of steam through the primary heat exchanger 34 and rely upon the heat exchanger 38 for the supply of heat to the side stream.

Turning now to a consideration of FIG. 3, after start-up, the conditions will be essentially the same as those described above in connection with FIG. 2. That is, the saturated flue gas withdrawn through the conduit 36 and returned to the main stream in the conduit 30 through the angled conduit 44 will be 251,248 pph. Also the amount of heated gas in the by-pass conduit 44 will be 30,333 pph and the gas flowing in the side stream which passes through the fan 36 and the heat exchanger 38 will be 281,581 pph. In the above determinations, the flue gas passing from the scrubber 10 is assumed to be saturated at 125° F. and the presence of droplets in this flue gas has been considered to have a negligible effect upon the calculations.

Whereas the present invention has been described in particular relation to the drawings and sketches attached hereto, it should be understood that other in further modifications, apart from those shown or suggested herein, may be made within the spirit and scope of this invention.

What is claimed is:

1. In the method of treating combustion or flue gas which results from the burning of coal or similar fuel in a boiler wherein the flue gas is passed through a wet scrubber and proceeds in a saturated condition as a flue gas stream to an exhaust fan and thence up a stack, and wherein a reheat heat exchanger is employed to heat the saturated flue gas subsequent to its treatment in the wet scrubber but prior to its introduction to the exhaust fan whereby the flue gas is heated to a sufficiently high temperature above its dew point that condensation is prevented in the exhaust fan and in the stack with a consequent elimination or reduction of corrosion in the fan and stack, the improvement which comprises heating at least a portion of the flue gas stream slightly above its dew point subsequent to its passage through the wet scrubber and prior to its passage through the reheat heat exchanger to prevent any condensation from the flue gas stream in the reheat heat exchanger, wherein a portion of the flue gas stream is withdrawn as a side stream from the flue gas stream at a location subsequent to the passage of the flue gas stream through the wet scrubber and prior to the passage of the flue gas stream to the exhaust fan, heating the side stream by locating the reheat heat exchanger in the side stream, inserting a separate fan in the side stream between said first location and said reheat heat exchanger to force the side stream through said reheat exchanger, by-passing a portion of the side stream immediately downstream from said reheat heat exchanger and back to the upstream side of said separate fan to add heat to the side stream whereby the side steam is maintained slightly above its dew point prior to its passage through said reheat heat exchanger, and reintroducing the side stream into the flue gas stream at a second location positioned downstream from said first location and prior to the introduction of the flue gas stream to the exhaust fan, wherein, for shut down purposes, a stream of ambient air is introduced to the side stream between said first location and said fan while simultaneously preventing the flow of flue gas into the side stream until the side stream is purged of flue gas.

* * * * *